United States Patent [19]

Bungert et al.

[11] 4,109,334

[45] Aug. 29, 1978

[54] SMOOTHING MACHINE FOR STITCH SEAMS

[75] Inventors: Heinrich Bungert; Herbert Wenz; Klaus Wentz, all of Kaiserslautern, Fed. Rep. of Germany

[73] Assignee: Pfaff Industriemaschinen GmbH, Fed. Rep. of Germany

[21] Appl. No.: 793,649

[22] Filed: May 4, 1977

[30] Foreign Application Priority Data

May 14, 1976 [DE] Fed. Rep. of Germany ..... 2661633

[51] Int. Cl.[2] ..... A43D 11/00

[52] U.S. Cl. ..... 12/59.5

[58] Field of Search ..... 12/59.5, 146 S

[56] References Cited

U.S. PATENT DOCUMENTS

| | | | |
|---|---|---|---|
| 2,316,884 | 4/1943 | Oliver | 12/59.5 |
| 2,442,035 | 5/1948 | Calder | 12/59.5 |
| 2,736,047 | 2/1956 | Roske | 12/59.5 |

*Primary Examiner*—Patrick D. Lawson

*Attorney, Agent, or Firm*—McGlew and Tuttle

[57] ABSTRACT

The machine smoothes stitched seams on shoe shanks and applies a tape to cover the smoothed seam. A driven frictional wheel is cooperable with a second friction wheel rotatably mounted on a relatively elongated support over and along which the shanks are fed, the two friction wheels pressing and smoothing the stitched seams. Two holding elements are releasably engageable with this support at supporting points thereon spaced longitudinally of the support. A control circuit operates in such a manner that the two holding elements initially clamp the support at points spaced longitudinally therealong and, as a shoe shank leaves the friction wheels, the leading holding element is released for passage of the shoe shank therethrough while the trailing holding element remains clamped on the support. As the shoe shank clears the leading holding element, the latter is again clamped on the support and the trailing holding element is released from the support for passage of the shank. As the shank leaves the trailing holding element, the latter is again clamped on the support.

10 Claims, 3 Drawing Figures

53
54
51
34
28
35
26
28
29
52
31
36
37
50
47
42
44
49
46
102
39
88
92
90
43
38
98
72
62
71
45
III
130
58
56
59
55
73
61
60
68
48
40
32

55
59
38
66
70
63
67
68
64
58
65
62
69
57
56
60
39
61

SMOOTHING MACHINE FOR STITCH SEAMS

FIELD AND BACKGROUND OF THE INVENTION

This invention relates to a smoothing machine for smoothing and compressing stitched seams on shoe shanks, and is of the type including a driven friction wheel, cooperable with a friction wheel rotatably mounted on a relatively elongated support over and along which the shoe shanks are fed, for compressing and smoothing the stitched seams.

If closed shoe shanks are processed on known machines of this type, they accumulate, after smoothing of their seams, around the support. Consequently, the support must be swingable to provide sufficient space between the two friction wheels to remove the shoe shanks.

Swinging out of the support after a certain sequence of operations on the machine requires, however, additional energy and represents also lost time in a production operation. The necessity of swinging out the support after several operations does not permit the use of such a smoothing machine in an automatic plant where the individual shoe shanks are automatically supplied and removed. Difficulties are also encountered in smoothing the rear seams of boot shanks, because the capacity of the shank support is very limited in this case.

SUMMARY OF THE INVENTION

In order to avoid the drawbacks of known arrangements, the technical problem to which the present invention is directed consists in providing a machine where the shoe shanks are removed during the normal working cycle and without moving the support out of its position.

As a solution of this problem, the present invention provides at least two holding elements mounted on the machine, and which grip the support alternately at supporting points spaced longitudinally from each other along the support, in such a manner that the support is always gripped by at least one holding element during travel of a shoe shank along the support.

Due to the large forces acting on the support during the seam smoothing operation, in a preferred embodiment of the invention, the control of the holding elements is so designed that both holding elements grip the support simultaneously, in a form-locking manner, during the smoothing operation, and release the support alternately for brief intervals during the time between smoothing of the seams of successive shoe shanks.

An advantageous gripping of the support, with simultaneous centering of the support, is obtained by designing the holding elements as holding tongs with swing-out jaws, where each pair of jaws has two three-point contacts acting on the support and which jaws are arranged symmetrically to each other.

Preferably, at least one latch is provided on each pair of jaws to secure the support against rotation or angular displacement about an axis extending longitudinally of the support, and another latch is provided to secure the support against movement in the longitudinal or axial direction. The latches can be wedge-shaped and can engage corresponding wedge-shaped grooves.

In order to prevent positively the support from changing its position while it is held by the holding tongs, the drive for each of the holding tongs is so designed that the movement of one jaw of a pair into its closing position is completed before the other jaw has moved into its closing position.

A particularly favorable solution of the problem of actuating the holding tongs is obtained if each jaw is operable by a toggle linkage with the drive for closing each jaw being connected to the pivot of the toggle linkage. Furthermore, a stop limits the movement of the toggle linkage of the jaw first reaching its closing position in the expanded condition of the associated toggle linkage. Due to this feature, it is possible to perform the movements, necessary for actuating the jaws, in a simple manner with little effort, and in which the given position of the support does not change while, at the same time, large holding forces are obtained, such as are necessary for retaining the support against movement during the stitched seam smoothing operation.

An object of the invention is to provide an improved machine for smoothing stitched seams on shoe shanks and in which the shoe shanks are removed from a support during the normal working cycle without moving the support out of its position.

Another object of the invention is to provide such a machine including two holding elements which grip the support alternately at supporting points spaced longitudinally along the support from each other.

A further object of the invention is to provide such a machine in which both holding elements grip the support simultaneously during the smoothing and compressing operation, and release the support, in alternation with each other, briefly during the time between successive smoothing and compressing operations.

For an understanding of the principles of the invention, reference is made to the following description of a typical embodiment thereof as illustrated in the accompanying drawings.

DESCRIPTION OF THE PREFERRED EMBODIMENT

Figure 1:
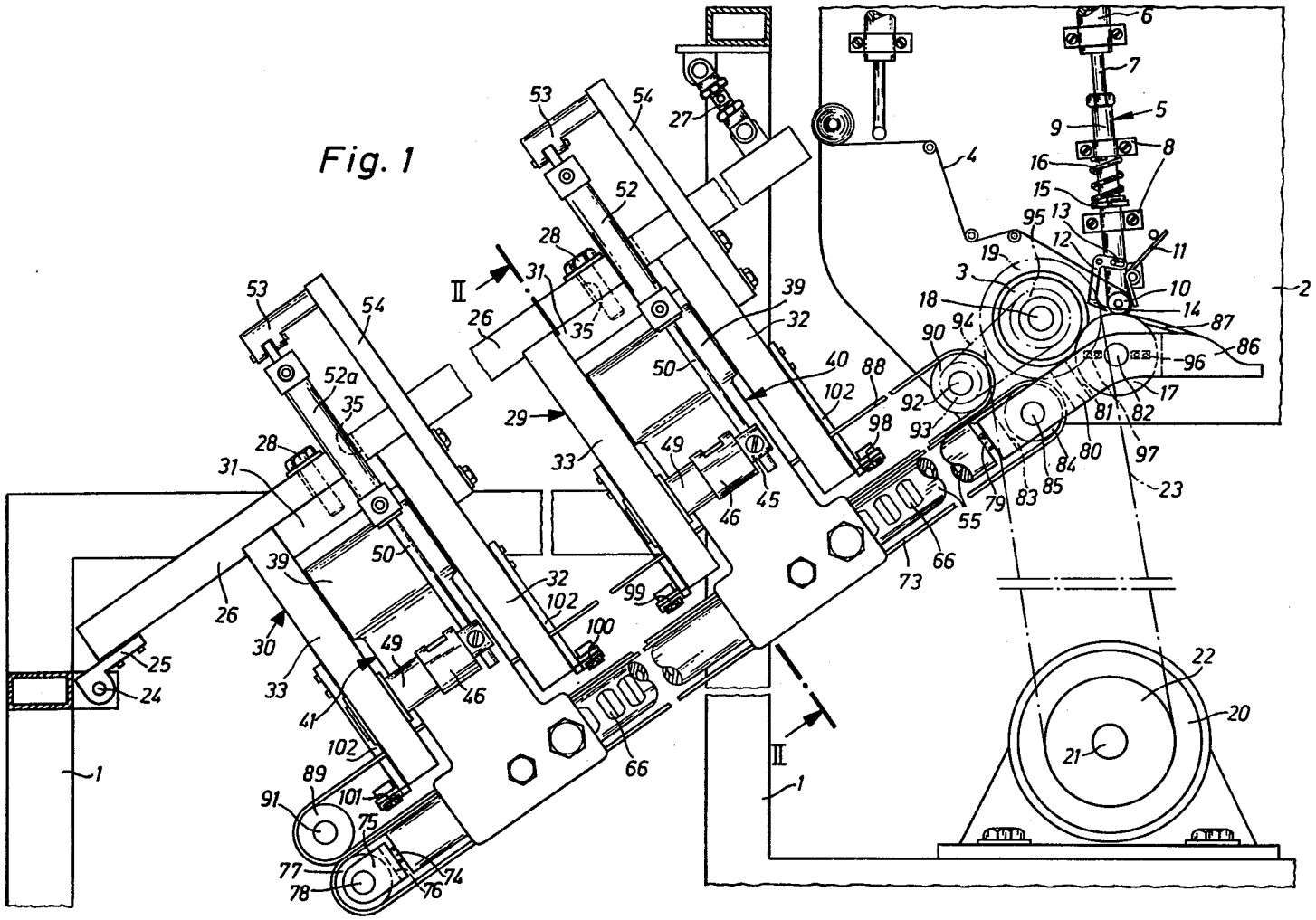
FIG. 1 is a general side elevation view of the machine embodying the invention.

Referring first to FIG. 1, the machine includes a frame 1 on which there is secured a vertically oriented plate 2 mounting a driven friction wheel 3, a feed mechanism for an adhesive tape 4, and a pressure and cutting mechanism 5 for tape 4. The pressure and cutting mechanism 5 includes a pneumatic cylinder 6, secured on plate 2, having a piston rod 7 fixedly connected with an operating bar 9 slidably guided in bearings 8 secured on plate 2. Bar 9 carries a pressure roll 10 on whose circumference adhesive tape 4 is held by a torsion spring 11. A cutter lever 12 is pivotally mounted on plate 2 and has a slotted connection 13 with bar 9. Cutter lever 12 performs a pivotal movement when bar 9 is displaced, to cut adhesive tape 4 by means of a cutter 14 on cutter lever 12. A compression spring 16 surrounds bar 9 and bears against one of the bearings 8 and a stop 15 secured on bar 9. Spring 16 presses pressure roll 10 against a second friction wheel 17 cooperating with driven friction wheel 3.

Friction wheel 3 is secured on a shaft 18 rotatably mounted in plate 3 and having secured thereto a belt pulley 19. Below plate 2, a motor 20 is mounted on frame 1 and has a take-off shaft 21 to which is secured a belt pulley 22 in driving connection with belt pulley 19 through the medium of a V-belt 23.

At its left end, as viewed in FIG. 1, frame 1 supports an axle 24 on which is mounted, by hinges 25, one end of a supporting plate 26 whose other end is also connected with frame 1 through longitudinally adjustable connecting rods 27. On the underside of supporting plate 26, screws 28 secure two identically designed U-shaped bearing brackets 29 and 30, each consisting of a connecting plate 31 and two spaced parallel side plates 32 and 33 secured to connecting plate 31. Bearing brackets 29 and 30 are guided on supporting plate 26 by respective guide ways 34 formed in the plates 31, and slots 35, in supporting plate 26, permit adjustment of the bearing brackets 29 and 30, these slots receiving the screws 28 connected to plates 31.

Figure 2:
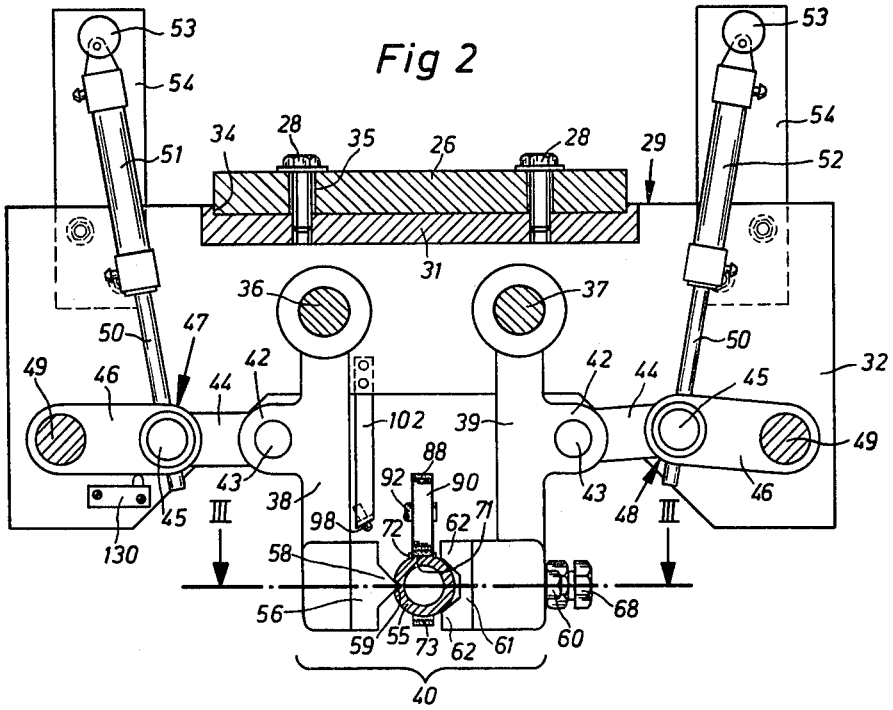
FIG. 2 is a section taken along the line II—II of FIG. 1.
Figure 3:
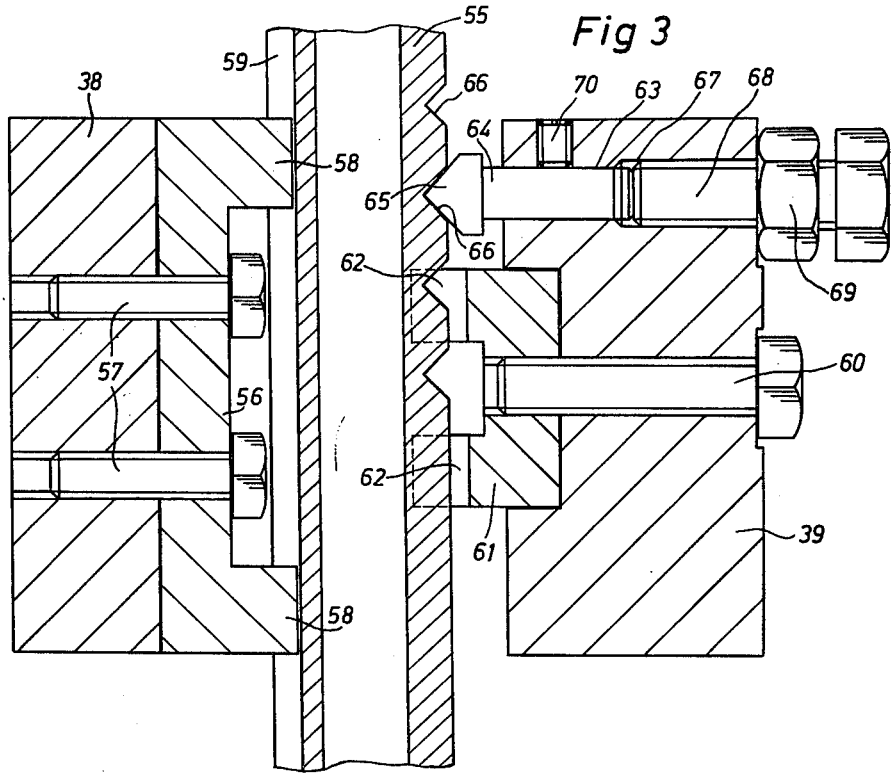
FIG. 3 is a section taken along the line III—III of FIG. 2.

Referring to FIG. 2, each bearing bracket 29 and 30 carries two axles or pivots 36 and 37 respectively mounting tongs parts 38 and 39, one pair of tongs parts forming part of a front or leading holding tongs 40 and the other pair or tongs parts being part of an identically designed rear or trailing holding tongs 41. Each tongs part 38 and 39 has a respective bearing lug 42 to which is secured, by means of a bearing pin 43, a guide link 44. Guide links 44 are connected by pins 45 with lever arms 46 to form respective articulated toggle joints 47 and 48 for the tongs 38 and 39, respectively. Each lever arm 46 is pivoted on a respective bolt 40, and bolts 40 are secured in side plates 33. Pins 45 project laterally from the hinge connection between guide link 44 and lever arm 46, and are drilled to receive the end of a respective piston rod 50. Piston rods 50 are associated with two pneumatic cylinders 51, 52 and 51*a*, 52*a*, respectively, which are articulated on respective bearing arms 53 carried by supporting arms 54 secured to side plates 32 of the bearing brackets 29 and 30.

Pneumatic cylinders 51, 52 and 51*a*, 52*a*, respectively, are of known design, and each pneumatic cylinder has two connecting sockets for air hoses. The respective piston rods 50 are so secured in the associated pins 45 that they are in their extended position when the toggle joints 47 and 48 are in their expanded or stretched positions. The stroke limitations, for the movement of the pistons of cylinders 51, 52 and 51*a*, 52*a*, respectively, thus have the function of stops for limiting the swinging movement of the toggle joints 47 and 48 beyond their stretched or extended positions.

Both holding tongs 40 and 41 serve to grip and hold a rod-shaped support 55 of tubular steel. To this end, a jaw 56 is secured on each tongs part 38 by means of two screws 57, and has two pressure extensions 58 spaced longitudinally of support 55 and which extend, in the form of a wedge, toward the axis of support 55, to engage a corresponding wedge-shaped longitudinal groove 59 of support 55.

Opposite jaws 56 and symmetrically thereto, a jaw 61 is secured on tongs part 39 by means of screws 60. Jaw 61 is formed, at its ends spaced longitudinally of support 55, with respective pressure extensions 62 directed toward support 55. It will be noted that jaw 61 has a much shorter extent along support 55 than does jaw 56. In this manner, a three-point contact of the pressure extensions 58 and 62 is obtained on both sides of the plane of symmetry of the jaws 56 and 61 across support 55, so that an exactly aligned position of support 55 is insured with either holding tongs 40 closed or with holdings tongs 41 closed.

A bolt 64 is displaceably mounted in a bore 63 of tongs part 39, and carries a wedge 65 which engages a selected one of plural corresponding wedge-shaped transverse groove in support 55, when holding tongs 40 or 41 is closed. Bore 63 is continued into a threaded bore 67 in which is provided an adjusting screw 68 by means of which the axial position of bolt 64 can be adjusted. The adjusted position of bolt 64 can be secured by a lock nut 69 screwed on adjusting screw 68, and the angular position of bolt 64 is secured by a set screw 70 in tongs part 39 and extending transversely of bolt 64.

On its upwardly directed side, support 55 has a flat 71 to which are bonded two longitudinally extending straps 72, provided on support 55 to form a guide way for an endless lower conveyor belt 73.

Referring again to FIG. 1, the rear or lower end of support 55 has inserted thereinto a pin 74 of a bearing piece 75 having a slot 76 in which there is rotatably mounted a guide roller 77 for conveyor belt 73, roller 77 being rotatable on an axle 78 in bearing piece 75. The front or upper end of support 55 has inserted and secured therein a pin 79 of a bearing piece 80. Bearing piece 80 is formed with a slot 81 across which there extends an axle 82 rotatably mounting a second friction wheel 17 as a counter part to driven friction wheel 3. Bearing piece 80 also is formed with another slot 83 across which there extends an axle 75 rotatably mounting a second roller 84 for conveyor bolt 73. Furthermore, bearing piece 80 terminates, at its free end, in a sword-shaped feed strap 86 having a bridging strap 87 extending tangentially to the circumference of second friction wheel 17.

Another endless conveyor belt 88 is mounted above conveyor belt 73 so that its lower run bears on the upper run of conveyor belt 73. Conveyor belt 88 is looped around two belt pulleys 89 and 90, of which belt pulley 89 is rotatably mounted on axle 91 secured in a known manner on frame 1. Belt pulley 90 is fixedly mounted on an axle 92 secured on plate 2, and this axle also has secured thereto a sprocket 93 which is in driving connection, through a chain 94, with the sprocket 95 secured on shaft 18.

Considered in the direction of movement of the shoe shanks through the machine, reflecting light barriers 96 and 97 are arranged, respectively, before and behind pressure roll 10, and are mounted on plate 2, these light barriers indicating a workpiece in the range of pressure roll 10. For each of the two reflecting light barriers 96 and 97, the plane side of second friction wheel 17 forms the reflecting surface. In addition, the presence of a workpiece in the range of front or leading holding tongs 40 is indicated by reflecting light barriers 98 and 99 and, in the range of rear or trailing holding tongs 41, by reflecting light barriers 100 and 101. These reflecting light barriers 98–101 are carried by respective holders 102 which are secured on side plates 32 and 33 of bearing brackets 29 and 30. With respect to reflecting light barriers 98-101, one side of longitudinal groove 59 in support 55 forms the reflecting surface.

Figure 4:
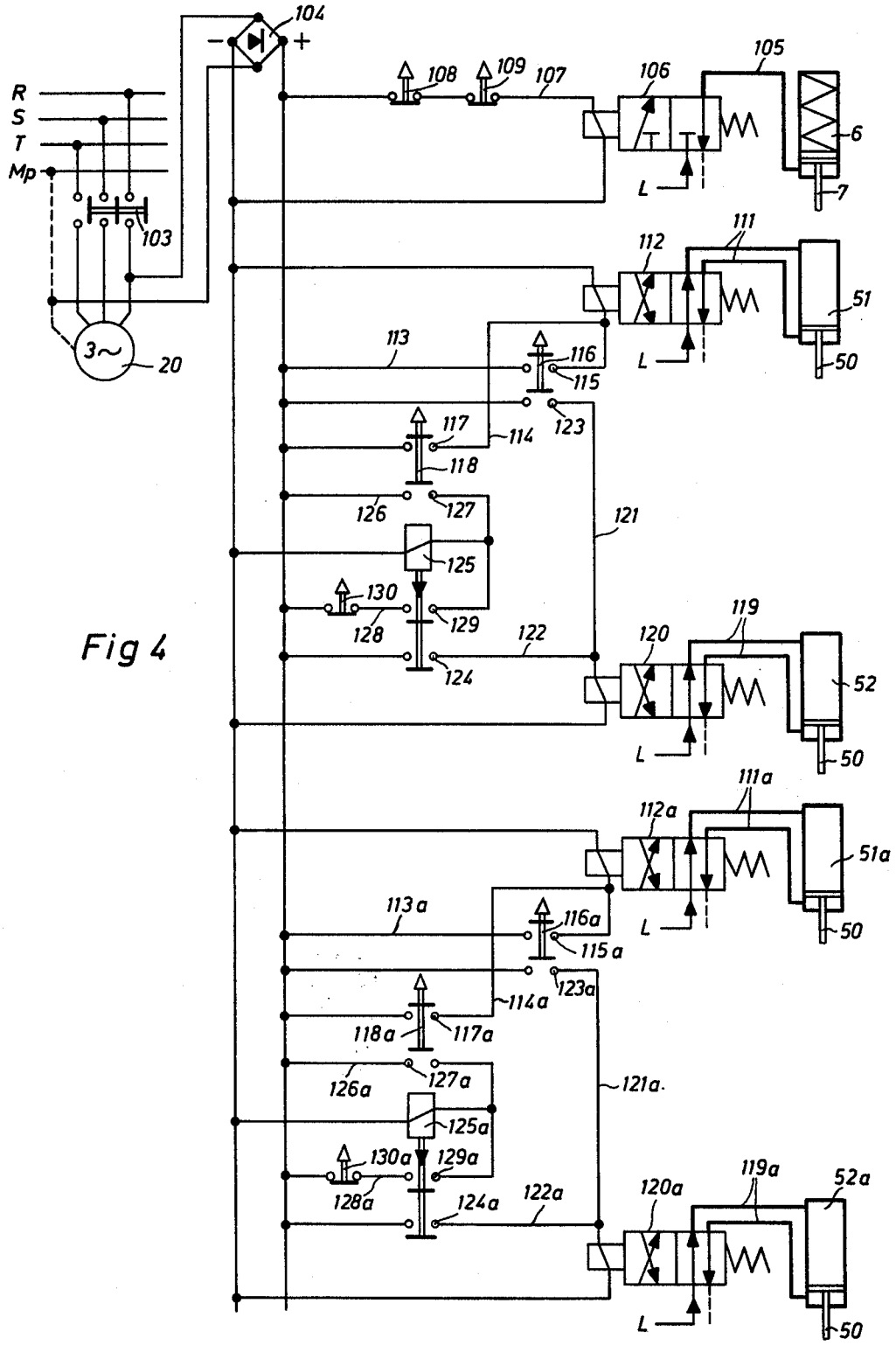
FIG. 4 is a simplified circuit diagram of the interconnection of the electrical and pneumatic controls of the stitched seam smoothing and compressing machine.

Referring now to FIG. 4, motor 20 of the pressing and smoothing machine is supplied with three-phase alternating current through lines R,S,T and $M_p$, through a master switch 103, while the control devices for the pneumatic cylinders 6, 51, 51a, 52 and 52a are operative with direct current provided by a rectifier 104 connected to the motor supply circuit.

The single action cylinder 6 serving to lift pressure roll 10 is connected, through a flexible air supply line 105, with an electromagnetic 3/2 way valve 106 (3 connections/2 switching positions). Valve 106 is connected across the output of rectifier 104 by a circuit 107 including switches 108 and 109 arranged in series with each other. Switch 108 is actuated by reflecting light barrier 96 and switch 109 is actuated by reflecting light barrier 97.

Cylinder 51 controlling tongs part 38 of front holding tongs 40 is connected, by flexible air supply lines 111, with an electromagnetic 4/2 way valve 112 connected, by parallel circuits 113 and 114, to the output of rectifier 104. In line 113, there are provided the operating contacts 115 of a switch 116 which is actuated by reflecting light barrier 98, while the operating contacts 117 of a switch 118 are arranged in line 114, with switch 118 being actuated by reflecting light barrier 99.

Cylinder 52, controlling the tongs part 39 of front holding tongs 40, is connected, by flexible air supply lines 119, with an electromagnetic 4/2 way valve 120 which also is connected by two parallel circuits 121 and 122 to the output of rectifier 104. In line 121, there are arranged the operating contacts 123 of switch 116 and, in line 122, there are arranged the operating contacts 124 of a relay 125. Relay 125 is connected by a circuit 126 to rectifier 104, with operating contacts 127 of switch 118 being arranged in line 126. In addition, self-holding circuit 128 connects relay 125 with rectifier 104 through operating contacts 129 of relay 125 which are in series with a limit switch 130. Limit switch 130 is closed by lever arm 46, connected with cylinder 51 of front holding tongs 40, in the extended position of the toggle linkage 47 shown in FIG. 2.

Cylinder **51*a*, cotrolling tongs part 38 of rear holding tongs 41, is connected by flexible air supply lines 111*a* with an electromagnetic 4/2 way valve 112*a*, which is connected to rectifier 104 by two parallel circuits 113*a* and 114*a*. In line 113*a*, there are arranged operating contacts 115*a* of the switch 116*a* actuated by reflecting light barrier 100, and, in line 114*a*, there are arranged operating contacts 117*a* of the switch 118*a* which is actuated by reflecting light barrier 101**.

Cylinder **52*a*, controlling tongs part 39 of rear holding tongs 41, is connected by flexible air supply lines 119*a* with a electromagnetic 4/2 way valve 120*a* connected to rectifier 104 by two parallel circuits 121*a* and 122*a*. In line 121*a*, there are arranged operating contacts 123*a* of switch 116*a* and, in line 122*a*, there are arranged operating contacts 124*a* of a relay 125*a*. Relay 125*a* is connected through a circuit 126*a*, in which there are arranged operating contacts 127*a* of switch 118*a*, to rectifier 104. In addition, a self-holding circuit 128*a* connects relay 125*a* with rectifier 104 through operating contacts 129*a* of relay 125*a* in series with the limit switch 103*a*. Limit switch 130*a* is closed by lever arm 46 connected with cylinder 51*a* of rear holding tongs 41 in the extended or stretched position of toggle joint 47**.

The machine operates in the manner which will now be described. Responsive to closing of master switch 103, motor 20 starts and drives, through belt pulley 22 and V-belt 24, belt pulley 19 and friction wheel 3 fixedly connected with belt pulley 19. At the same time, sprocket 95 fixedly connected by shaft 18 with friction wheel 3 which drives chain 94, through sprocket 93, drives belt pulley 90 which sets upper conveyor belt 88 into motion. By frictional entrainment, conveyor belt 88 entrains lower conveyor belt 73 to set the latter in motion. Second friction wheel 17 bears on driven friction wheel 3 and is therefore also driven by the latter.

Also responsive to closing of master switch 103, with application of an input potential to rectifier 104, electromagnetic valve 106 is switched, through circuit 107, due to the closed switches 108 and 109, so that cylinder 6 is supplied with air through lines 105 and lifts, through its operating bar 9, pressure and cutting mechanism 5 for adhesive tape 4, against the force of compression spring 16.

The two holding tongs 40 and 41 are in the their closed position gripping support 55, so that the machine is ready to use. The operator, or a suitable automatic feeding mechanism, now places a shoe shank, having a stitched seam to be compressed and smoothed, on feed strap 86 and conducts the shoe shank between friction wheel 17 and pressure roll 10.

When the front edge of the shoe shank passes reflecting light barrier 96, switch 108 is actuated to the open position so that valve 106 is switched and air is exhausted from cylinder 6. Compression spring 16 pushes operating bar 9 down and pressure roll 3 presses on the seam of the entering shoe shank, with adhesive tape 4 remaining on the seam due to its adhesive coating.

As soon as the front edge of the shoe shank enters between the two friction wheels 3 and 17, these wheels grip and move the shoe shank and press the seam flat in a known manner. At the same time, adhesive tape 4, covering the seam, is also pressed on permanently.

When the front edge of the shoe shank passes reflecting light barrier 97, it opens switch 109 so that reflecting light barrier 96 can close switch 108 when light barrier 96 is made to respond to the rear edge of the shoe shank, without switching valve 106.

As soon as the rear edge of the shoe shank passes reflecting light barrier 97, switch 109 closes. This switches valve 106 so that cylinder 6 is again supplied with air through line 105 and piston rod 71 again lifts operating bar with pressure roll 10 and against the action of compression spring 16. Cutter lever 12 performs a pivotal movement toward adhesive tape 4 so that its cutter 14 cuts the adhesive tape. The front part of the shoe shank has, in the meantime, run onto the lower conveyor belt 73 and thus arrives between conveyor belts 73 and 88 so that the shoe shank is transported to the rear.

When the front edge of the shoe shank passes reflecting light barrier 98, switch 116 closes its operating contacts 115 and 123. A circuit to electromagnetic valve 112 is thus closed over circuit 113, and cylinder 51 is supplied with compressed air through lines 111 so that its piston rod 50 is retracted into cylinder 51. At the same time, the circuit to electromagnetic valve 120 is closed, through circuit 121, and cylinder 52 is so supplied with compressed air, through line 119, that its piston rod 50 is likewise retracted into cylinder 52.

The piston rods of the two cylinders 51 and 52 lift pins 45 and thus bend the toggle joints 47 and 48, comprising guide links 44 and lever arms 46, to an angular position such that jaws 56 and 61 of tongs part 38 and 39 of front or leading tongs 40 open. The shoe shank is now transported by conveyor belts 73 and 88 unhindered through the range of the leading holding tongs 40.

When the rear edge of the shoe shank passes reflecting light barrier 99, switch 118 closes its operating contacts 117 and 127 so that electromagnetic valve 112 is now also connected, through circuit 114, to rectifier 104. Relay 125 is excited by closing of operating contacts 124 and 129. Self-holding circuit 128 is thus closed, which keeps relay 125 energized. In addition, electromagnetic valve 120 is connected to rectifier 104 over it second circuit 122.

When the rear edge of the shoe shank passes reflecting light barrier 98, switch 116 opens to interrupt both the circuit 113 to valve 112 and the circuit 121 to valve 120. Since valve 112 is still connected to rectifier 104 of circuit 114 and valve 120 over circuit 122, nothing is changed in the switching states of the valves 112 and 120.

However, when the rear edge of the shoe shank passes reflecting light barrier 99, switch 118 opens circuit 114 to valve 112 through operating contacts 117. Valve 112 switches and supplies the opposite end of cylinder 51 with air. Piston rod 50 is thus extended from cylinder 51 and presses toggle joint 47 to its expanded or stretched position, tongs part 38 moves with its jaw 56, towards support 55, and pressure extensions 58 of jaw 56 engage the longitudinal groove 59 of support 55. In addition, switch 118 opens circuit 126 to relay 125 through operating contacts 127, but relay 125 remains energized through self-holding circuit 128.

In the stretched or expanded position of toggle joint 47, lever arm 46 actuates limit switch 130 to open its normally closed contacts. Self-holding circuit 128 for relay 125 is thus interrupted, so that relay 125 drops and both operating contacts 129, of self-holding circuit 128, and operating contacts 124, in circuit 122 to valve 120, open. Valve 120 switches and piston rod 50 is pushed out of cylinder 52 and presses toggle joint 48 almost into a stretched position until the pressure extensions 62 of jaw 61 bear on support 55. Support 55 is now firmly gripped by the two jaws 56 and 61 of the front or leading holding tongs 40. At the same time, wedge 65 engages the respective transverse groove 66. Support 55 is thus firmly held in its axial position and in its angular position, the latter being effected by pressure extensions 58 engaging longitudinal groove 59.

The above-described measures assure not only gripping free from play but also an exact axial alignment and the rotary position of support 55 by front holding tongs 40. Due to the delayed response of cylinder 52 relative to cylinder 51, piston rod 50 of cylinder 51 is first extended and toggle joint 47 is brought into its stretched condition where extensions 58 of jaw 56 engage groove 59 in support 55 to assure the exact angular position and the axial position of support 55. Following this, toggle joint **48*a* is brought into its extended position, although this toggle joint is so dimensioned that it does not quite attain its completely stretched or expanded position, although holding tongs 41, when closed, assures a firm grip of support 55 by jaw 61 and wedge 65**.

The movements of the two articulated joints 47 and 48 need not necessarily be successive, as they can also overlap when controlled by corresponding measures.

In the further conveyance of the shoe shank by conveyor belt 73 and 88, the opening and closing, during the passing of a shoe shank, as described for front holding tongs 40, takes place in the same manner in the identically designed rear holding tongs 41 as soon as the front edge of the shoe shank passes reflecting light barrier 100 and ends after reflecting light barrier 101 has indicated that the shoe shaft has left the range of rear holding tongs 41.

Conveyor belts 73 and 88 now convey the shoe shank to their ends, where it drops by gravity into a collecting container. As soon as the rear edge of the shoe shank has passed reflecting light barrier 101, the pressing and smoothing operating for the next shoe shank can start.

Reflecting light barriers 96–101 are so connected with each other, in sequence operation, that both holding tongs 40 and 41 are closed as long as the shoe shank is indicated by one of the two light-reflecting barriers 96 and 97 in the range of friction wheels 3 and 17, so that only front holding tongs 40 is opened, as soon as a shoe shank is indicated by one of the two reflecting light barriers 98 and 99 provided in this range, and that finally only the rear holding tongs 41 is opened as soon as a shoe shank is indicated by one of the two light barriers 100 and 101 provided in the range of the rear holding tongs 41.

A change in the position of the holding tongs 40 and 41, for the treatment of shoe shafts with different longitudinal dimensions of the stitched seam, is possible by loosening the two screws 28 and displacing bearing brackets 29 and 30. The extent of the displacement must be so selected that wedge 65 again engages a transverse groove 66 in support 55 with holding tongs 40 or 41 closed. In this way, optimum passage conditions can be obtained for processing shoe shanks of different sizes. The adjustment of the spacing between friction wheels 3 and 17 is effected by changing the length of the connecting rods 27 extending between supporting plate 26 in frame 1.

While a specific embodiment of the invention has been shown and described in detail to illustrate the application of the principles of the invention, it will be understood that the invention may be embodied otherwise without departing from such principles.

What is claimed is:

1. In a machine for smoothing stitched seams on shoe shanks, and of the type including a driven friction wheel, cooperable with a friction wheel rotatably mounted on a relatively elongated support over and along which the shoe shanks are fed, for compressing and smoothing the stitched seams, the improvement comprising, in combination, at least two holding elements mounted on said machine and releasably engageable with said support at supporting points thereon spaced longitudinally of said support; and means operable to disengage said holding elements from said support alternately during the period between successive seam compressing and smoothing operations.

2. In a machine for smoothing stitched seams on shoe shanks, and of the type including a driven friction wheel, cooperable with a friction wheel rotatably mounted on a relatively elongated support over and along which the shoe shanks are fed, for compressing and smoothing the stitched seams, the improvement comprising, in combination, at least two holding elements mounted on said machine and releasably engageable with said support at supporting points thereon spaced longitudinally of said support; and operating means for said holding elements operating all said holding elements to grip said support in a formlocking manner during compressing and smoothing of a seam, and operating said holding elements to successively release said support as a shoe shank on said support passes through the range of a holding element and then to re-grip said support, during the time between successive seam compressing and smoothing operations; said support being gripped by at least one holding element at all times.

3. In a machine for smoothing stitched seams on shoe shanks, the improvement claimed in claim 2, in which said holding elements are holding tongs; each holding tongs including a pair of cooperable swing-out jaws; each pair of jaws having three-point contacts acting on said support and arranged symmetrically relative to each other.

4. In a machine for smoothing stitched seams on shoe shanks, the improvement claimed in claim 3, including at least one latch provided on each pair of jaws and operable to secure said support against angular and longitudinal displacement.

5. In a machine for smoothing stitched seams on shoe shanks, the improvement claimed in claim 3, in which one jaw of each pair carries a latch engageable with said support to secure said support against angular displacement, and the other latch of each pair carries a latch engageable with said support to secure said support against longitudinal displacement.

6. In a machine for smoothing stitched seams on shoe shanks, the improvement claimed in claim 5, in which said latches are wedge-shaped and engage corresponding wedge-shaped grooves in said support.

7. In a machine for smoothing stitched seams on shoe shanks, the improvement claimed in claim 6, in which said latch on said one jaw of each pair engages a wedge-shaped groove extending longitudinally of said support; the latch on the other jaw of each pair being engageable with wedge-shaped grooves extending transversely of said support in longitudinally spaced relation to each other.

8. In a machine for smoothing stitched seams on shoe shanks, the improvement claimed in claim 3, including a respective drive for each jaw of a pair, operable to move the associated jaw into gripping engagement with said support; the drive of one jaw of each pair moving its associated jaw completely into the support gripping position before the drive of the other jaw of each pair moves its associated jaw completely into its support gripping position.

9. In a machine for smoothing stitched seams on shoe shanks, the improvement claimed in claim 8, in which the drive for each jaw of a pair comprises a toggle linkage including a link connected to the jaw, a pivoted lever, and a pivot interconnecting said link and said pivoted lever; respective means connected to said last-named pivot and operable to move the associated toggle linkage into its extended position to grip said support; and a stop limiting movement of the toggle linkage of the jaw first reaching its support gripping position in the extending condition of its associated toggle linkage.

10. In a machine for smoothing stitches seams on shoe shanks, the improvement claimed in claim 3, including a support plate extending parallel to the direction of movement of a shoe shank through said machine; and means mounting said holding tongs on said support plate for adjustment longitudinal thereof to adjust the spacing between said holding tongs in accordance with the length of a shoe-shank passing through said machine.

* * * * *